US005156080A

United States Patent [19]

Pelto-Huikko

[11] Patent Number: 5,156,080

[45] Date of Patent: Oct. 20, 1992

[54] CONTROL VALVE FOR A HYDRAULIC ELEVATOR

[75] Inventor: Raimo Pelto-Huikko, Vantaa, Finland

[73] Assignee: Kone Elevator GmbH, Baar, Switzerland

[21] Appl. No.: 629,902

[22] Filed: Dec. 19, 1990

[30] Foreign Application Priority Data

Dec. 19, 1989 [FI] Finland ..... 896102

[51] Int. Cl.[5] ..... F15B 13/043

[52] U.S. Cl. ..... 91/461; 60/329; 187/29.2; 187/110; 251/25; 251/30.02; 251/63

[58] Field of Search ..... 251/25, 30.02, 63; 91/461; 60/329; 187/29.2, 110

[56] References Cited

U.S. PATENT DOCUMENTS 2,986,368 5/1961 Moore ..... 251/258
4,694,935 9/1987 Lawrence .

FOREIGN PATENT DOCUMENTS 2635908 2/1978 Fed. Rep. of Germany .
2908020 9/1980 Fed. Rep. of Germany .
1304620 1/1973 United Kingdom .

*Primary Examiner*—Gerald A. Michalsky
*Attorney, Agent, or Firm*—Sughrue, Mion, Zinn, Macpeak and Seas

[57] ABSTRACT

Control valve for a hydraulic elevator provided with a speed regulating plug which moves in response to the flow of the hydraulic fluid and whose position determines the flow of hydraulic fluid into the actuating cylinder of the elevator. At each end of the speed regulating plug, there is connected a system of hydraulic channels in which the hydraulic fluid flows, and which communicates with the main hydraulic circuit. An additional channel is connected to the hydraulic channel system, the additional channel being provided with a flow resistance component comprising a capillary throttle and a pressure compensated reservoir, such that the flow of hydraulic fluid through the additional channel is varied in inverse relation to the viscosity of the fluid. By this means, the closing speed of the speed regulating plug, and thus the deceleration rate of the elevator, is maintained constant throughout the operating temperature range of the hydraulic fluid.

3 Claims, 2 Drawing Sheets

CONTROL VALVE FOR A HYDRAULIC ELEVATOR

BACKGROUND OF THE INVENTION

1. Field of the Invention

The present invention relates to control valves for hydraulic elevators.

2. Brief Description of the Prior Art

A conventional hydraulic elevator control valve is provided with a main hydraulic channel through which the main flow of hydraulic fluid passes; a movable speed regulating plug disposed in the flow of hydraulic fluid; and a system of secondary hydraulic channels, which are connected to each end of the speed regulating plug, and which communicate with the main hydraulic channel, such that, when the control valve is closing, one flow component of hydraulic fluid flows out of the space at one end of the speed regulating plug, and a second flow component flows through a throttle and then into the space at the other end of the speed regulating plug. The speed regulating plug thus moves with the flow of hydraulic fluid, and the position of the speed regulating plug determines the rate of flow of the hydraulic fluid into the actuating cylinder of the elevator, thereby controlling the speed of the elevator.

The viscosity of oil, which is the hydraulic fluid most commonly used in hydraulic elevators, is reduced by about a decade as the oil is heated from the lowest working temperature to the highest working temperature. In the case of an elevator provided with a pressure-controlled ON- OFF-type control valve, this has the effect of producing an increase in deceleration with an increase in temperature, because the reduced kinetic resistance to movement of the valve plug, offered by the oil, allows the control valve to close faster.

In principle, deceleration of the elevator is based on a hydromechanical time reference. After the supply of electricity to the magnetic valve has been interrupted, a spring pushes the speed regulating plug of the control valve towards the closed position, while a throttle in the secondary hydraulic circuit supplying the speed regulating plug retards the closing of the valve. It is important to notice that the closing speed depends on the viscosity of the oil even in the case of a fully viscosity-independent throttle, because the kinetic resistance to movement of &:he speed regulating plug depends on the oil viscosity. As the kinetic resistance diminishes in response to reduced viscosity, the pressure difference across the throttle increases, producing an increase in the rate of flow in the secondary channel, towards the speed regulating plug, and therefore an increase in the plug speed.

A problem in this case is that the elevator, when working at "normal operating temperature", has an excessively long creeping time when arriving at a landing. This is because the distance at which the deceleration vanes in the hoistway are spaced from the landing must be adjusted for the lowest oil temperature to avoid overtravel.

German patent application publication DE 2908020 proposes a device for decelerating a hydraulic elevator by means of throttles and valves controlling the open position of the by-pass valve. The adjustment depends on the temperature of the hydraulic fluid. However, the device has the disadvantage that it uses a magnetic valve, necessitating a connection to the electrical system, thus rendering the solution too complex.

SUMMARY OF THE INVENTION

One of the main objects of the present invention is to provide a control valve for a hydraulic elevator which achieves compensation for variations in the viscosity of the hydraulic fluid, in a simple manner, so as to maintain the creeping distance essentially constant throughout the range of operating temperatures of the oil.

The control valve of the invention is characterized in that it comprises, in addition to the conventional channels and throttle, an additional channel which is connected to the secondary hydraulic channel system. This additional channel is provided with a flow resistance component, such that the flow through the additional channel is varied in inverse relation to the fluid viscosity, and thereby maintains the rate of fluid flow into the speed regulating plug essentially constant throughout the range of operating temperatures of the oil.

The control valve of the invention has the advantage that it provides a control valve for hydraulic elevators that is independent of variations in the viscosity of the oil, thus ensuring reliable deceleration of the elevator and making it more comfortable for the passengers.

BRIEF DESCRIPTION OF THE DRAWINGS

A preferred embodiment of the invention will now be described in more detail, with reference to the appended drawings, wherein.

DESCRIPTION OF THE PREFERRED EMBODIMENTS

Figure 1:
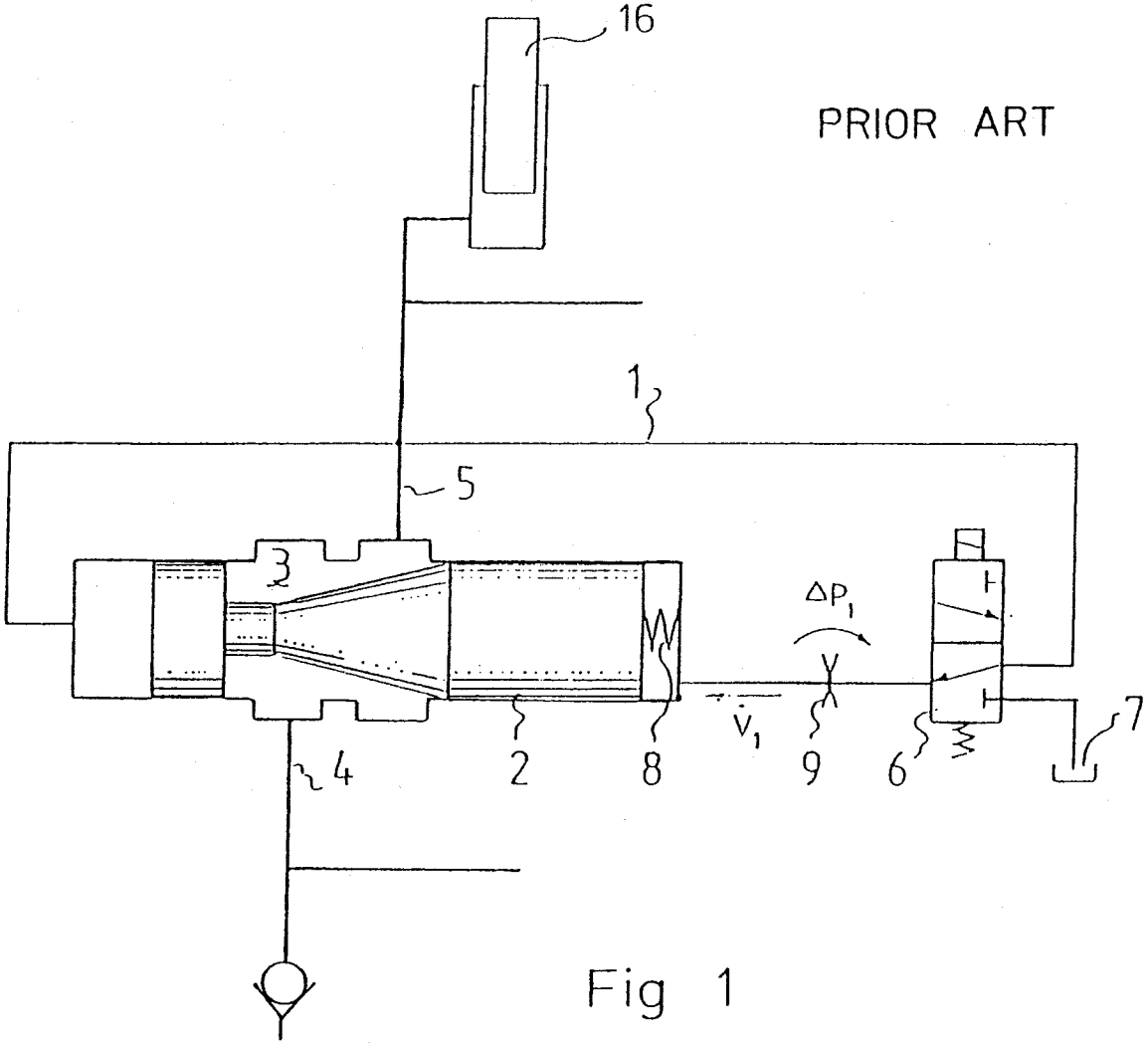
FIG. 1 shows diagrammatically a part of a conventional control valve for a hydraulic elevator, said part comprising a speed regulating plug and a hydraulic channel system.

FIG. 1 shows part of the conventional hydraulic channel system 1, of the control valve of a hydraulic elevator, comprising a speed regulating plug 2 which moves in an essentially closed space 3 provided for it. The hydraulic fluid in the main channel flows from the inflow channel 4, through the space 3, to the outflow channel 5, which leads to the actuating cylinder 16 of the elevator. The middle part of the speed regulating plug is of an essentially conical form, as illustrated. Thus, when the plug moves longitudinally to the left (as seen in FIG. 1), it throttles the flow of hydraulic fluid in the main channel 4, 5. The flow is therefore greatest when the plug is in its extreme right position (as seen in FIG. 1). The elevator speed decreases when the spring 8 pushes the speed regulating plug 2 towards the closed position, i.e. to the left in FIG. 1. As a result of this closing movement of the speed regulating plug 2, the oil used as hydraulic fluid will pass from the space at the left-hand end of the speed regulating plug 2, and flow in the hydraulic channel system 1 through the distributing valve 6 and the throttle 9, which chokes (or restricts) the mass flow rate, and finally into the spring space to the right of the speed regulating plug 2. Thus, the closing speed of the speed regulating plug 2 movement is determined by the throttle 9.

In the position shown in FIG. 1, the 3/2-way distributing valve 6 provided in the hydraulic channel system 1 permits a fluid flow towards the speed regulating plug 2. In this situation, the regulating valve is closing, and the elevator is being decelerated. As the temperature of the hydraulic fluid rises during use, its viscosity is reduced, thus reducing the kinetic resistance, offered by the oil, to movement of the speed regulating plug 2. As a consequence of the reduced kinetic resistance, the pressure difference $P_0$ - $P_1$ across the throttle 9 increases, increasing the flow $V_1$. The increased flow allows the speed regulating plug 2 to close faster, resulting in a greater rate of deceleration of the elevator. The change in the mass flow rate, of hydraulic fluid, through the throttle 9 between the operating temperature extremes is about 30%, and the variation in deceleration in previously known control valves is proportional to this. This variation in deceleration is one of the drawbacks of previously known control valves.

When the 3/2 way distributing valve 6 is in its alternate position, the hydraulic fluid is allowed to flow from the right-hand side of the speed regulating plug 2, into the tank 7, until the speed regulating plug 2 has reached its fully open position and the elevator is travelling at full speed.

Figure 2:
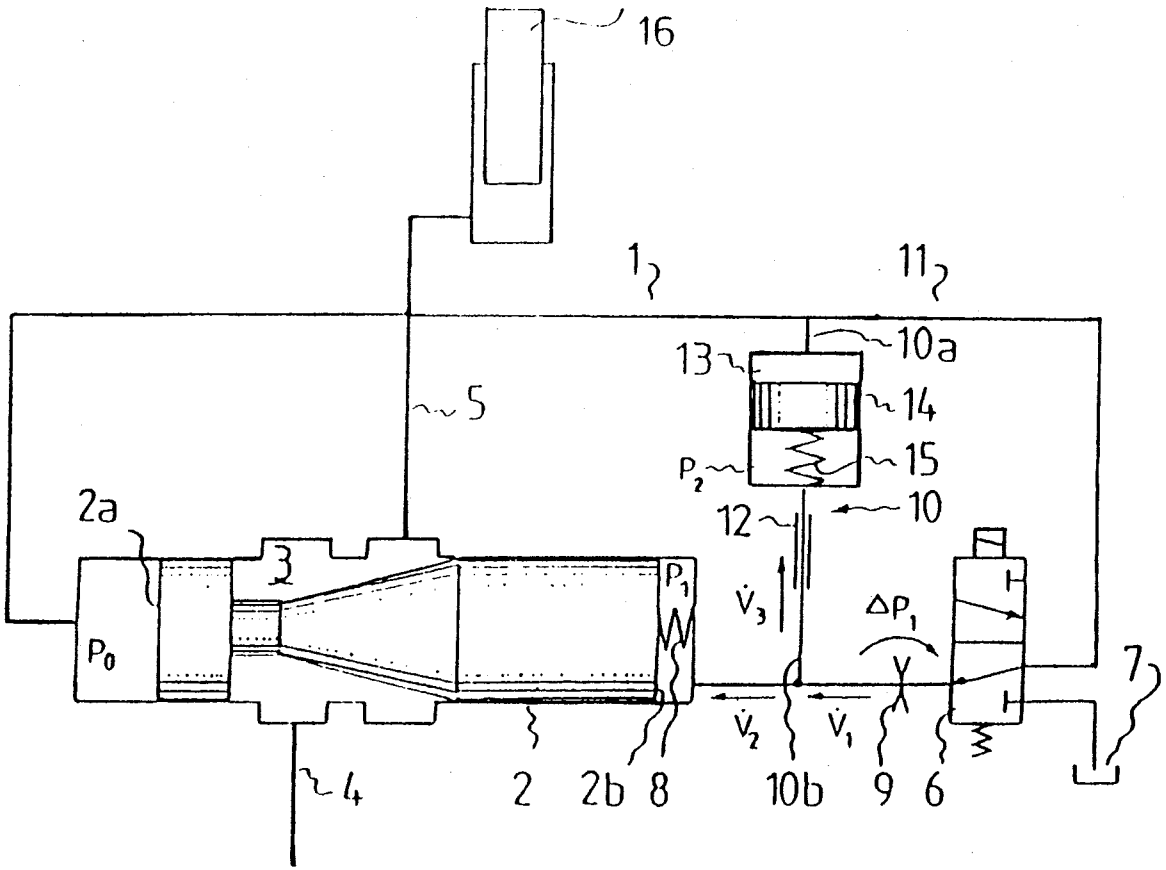
FIG. 2 shows diagrammatically a part of a control valve of the invention, which is similar to that shown in FIG. 1, but provided with an additional branch.

FIG. 2 illustrates the control valve of the invention, in which the hydraulic channel system 1 comprises, in addition to a distributing valve 6 and a throttle 9, an additional channel 10. The first end 10*a* of additional channel 10 is connected to the hydraulic channel system 1 at a point where the pressure is the same as the pressure at the first end 2*a* of the speed regulating plug 2. This pressure is designated $P_0$ in this context. Similarly, the second end 10*b* of additional channel 10 is connected to the hydraulic channel 1 at a point where the pressure is the same as the pressure at the second end 2*b* of the speed regulating plug 2. This pressure is designated P1. In the embodiment described here, the first end of the additional channel is connected to a point between distributing valve 6 and the first end 2*a* of speed regulating plug 2, whereas the second end 10*b* of additional channel 10 is connected to a point between throttle 9 and the second end 2*b* of speed regulating plug 2.

The additional channel 10 is provided with a flow resistance component consisting of a capillary throttle 12 which chokes (or restricts) the volume flow rate of hydraulic fluid, a cylinder 13, an auxiliary piston 14 moving in cylinder 13, and a spring 15 connected between the cylinder 13 and the auxiliary piston 14, said spring 15 acting in the direction of movement of the auxiliary piston 14. The capillary throttle 12 is connected in series with the cylinder-piston-spring assembly 13-15 as illustrated in FIG. 2.

As described above, the first end 10*a* of the additional channel 10 is connected to the hydraulic channel 1 at a point where the pressure is $P_0$. Thus the fluid pressure in the cylinder 13, on one side of the auxiliary piston 14 is also $P_0$. The other end 10*b* of the additional channel 10 is connected to the hydraulic channel 1 at a point where the pressure is $P_1$. Notice that pressure $P_0$ is greater than pressure $P_1$ as a result of the pressure drop induced by the fluid flow V through throttle 9.

The spring 15 disposed in the cylinder 13 bears against one side of the auxiliary piston 14 so as to oppose the high pressure $P_0$ on the other side of the piston 14. Furthermore, the flow restriction imposed by the capillary throttle 12 is such that the pressure $P_2$, in the spring space of the cylinder 13, is lower than the pressure $P_1$ at end 10*b* of the auxiliary channel 10. The stiffness of the spring 15 is therefore suitably chosen so as to compensate for the pressure difference $P_0$ - $P_2$ across the auxiliary piston 14. The pressure difference $P_1$ - $P_2$ causes fluid flow $V_3$ through the capillary throttle 12 and into the spring space of the cylinder 13. It will be obvious to those skilled in the art that the volume of cylinder 13, must be appropriately selected, taking into consideration the volume of the hydraulic channel system 1 and the spring space at the end 2*b* of the speed regulating plug 2.

When the distribution valve 6 is in its other position, allowing the speed regulating plug 2 to move to its open position (to the right in FIG. 2), pressure $P_1$ drops to a low value by virtue of the connection to the reservoir 7. When this occurs, pressure $P_2$ becomes greater than pressure $P_1$, and fluid flow $V_3$ reverses. The reverse direction of flow $V_3$ causes the auxiliary piston 14 to move toward end 10*b* of the auxiliary channel 10, compressing the spring 15 in preparation for the next deceleration cycle of the elevator.

The action of the viscosity-compensated system of the invention, during deceleration of the elevator is as follows. The flow $V_1$ from the throttle 9 to the speed regulating plug 2 is divided into two components, one of which ($V_2$) flows to the speed regulating plug. The other component ($V_3$) flows to the flow resistance component 12-15 in the additional channel 10 as described above. The capillary throttle 12 is a tubular choker which operates based on the internal friction of the fluid. The flow through the capillary throttle 12 is inversely proportional to the viscosity of the fluid, so that if the viscosity is reduced, for example to 1/10, the flow ($V_3$) in the capillary throttle 12 is increased to an almost tenfold value. By contrast, throttle 9 chokes the mass flow rate of the fluid flow $V_2$, which does not change much with rising temperature and falling viscosity.

The operation of the invention may be more clearly understood by the following example. The hydraulic fluid typically used in hydraulic elevators is oil, whose temperature varies between 10° C. and 60° C. during use. The viscosity of warm oil is approximately 10 times lower than that of cold oil. Due to the size of the speed regulating plug 2 and the stiffness of spring 8, the volume flow rate of the hydraulic fluid flow $V_1$ is, for example, 16 units of volume (uv)/second for cold oil, and 25 uv/s for warm oil. The flow resistance component 12-15 is so dimensioned that when the oil is cold and the volume flow rate of fluid flow $V_1$ is 16 uv/s, the volume flow rate of fluid flow $V_3$ will be 1 uv/s and the volume flow rate of flow $V_2$, going to the speed regulating plug 2, will be 15 uv/s. As the temperature rises to the maximum value of 60 C., the volume flow rate of fluid flow $V_1$ increases to a value of 25 uv/s. The oil, whose viscosity has been reduced to 1/10, now flows at a rate through the capillary throttle 12 that is increased tenfold, i.e. the volume flow rate of flow $V_3$ is increased to 10 uv/s, which means that the volume flow rate of flow $V_2$ is maintained at 15 uv/s. In this manner, flow $V_2$ has been rendered independent of variations in the viscosity of the oil used as hydraulic fluid. Therefore, a constant closing speed of the regulating plug 2, and thus a constant deceleration rate of the elevator, is maintained.

If desired, even a diminishing closing speed with rising temperature can be achieved. This makes it possible, for example, to compensate for the effects of pump leakage.

It is obvious to a person skilled in the art that the invention is not restricted to the examples of its embodiments described above, but that it may instead be varied within the scope of the following claims.

I claim:

1. A hydraulic elevator control valve comprising:

(a) a main hydraulic channel, through which the main flow of the hydraulic fluid passes to and from an actuating cylinder of the elevator;

(b) a speed regulating plug, disposed in said main channel and responsive to the flow of hydraulic fluid, the position of said speed regulating plug determining the flow of hydraulic fluid into the actuating cylinder of the elevator;

(c) a system of hydraulic channels, connected to each end of said speed regulating plug and communicating with said main hydraulic circuit, such that when said speed regulating plug is closing, one component of hydraulic fluid flow passes out of the space at one end of said speed regulating plug, and a second flow component of hydraulic fluid flows through a throttle and into the space at the other end of said speed regulating plug;

(d) an additional channel, connected to said system of hydraulic channels; and (e) means for varying the rate of flow of hydraulic fluid through the additional channel in inverse proportion to the viscosity of the hydraulic fluid, such that the closing speed of said speed regulating plug is maintained constant throughout the operating temperature range of the hydraulic fluid, said means for varying the rate of flow comprising a flow resistance component embodied in said additional channel.

2. Control valve according to claim 1, wherein a first end of said additional channel is connected to said system of hydraulic channels at a point where the pressure is the same as the pressure at a first end of said speed regulating plug, and a second end of said additional channel is connected to said hydraulic channel at a point where the pressure is the same as the pressure at a second end of the speed regulating plug.

3. Control valve according to claim 1, wherein said flow resistance component comprises an auxiliary piston movably disposed within a cylinder, a spring connected between said cylinder and said auxiliary piston, and a capillary throttle connected in series with the cylinder-piston-spring assembly.

* * * * *